US007201712B2

(12) United States Patent
Tiahrt

(10) Patent No.: US 7,201,712 B2
(45) Date of Patent: Apr. 10, 2007

(54) OSCILLATORY RESISTANCE EXERCISE DEVICE AND METHOD

(76) Inventor: Leif Tiahrt, 114 A Chapala St., Santa Barbara, CA (US) 93101

( * ) Notice: Subject to any disclaimer, the term of this patent is extended or adjusted under 35 U.S.C. 154(b) by 256 days.

(21) Appl. No.: 10/620,028

(22) Filed: Jul. 14, 2003

(65) Prior Publication Data

US 2005/0014616 A1 Jan. 20, 2005

(51) Int. Cl.
*A61B 21/062* (2006.01)

(52) U.S. Cl. ..... 482/133

(58) Field of Classification Search ..... 482/93–94, 482/97–103, 121, 135–136, 138–139, 72, 482/70–71

See application file for complete search history.

(56) References Cited

U.S. PATENT DOCUMENTS

| | | | | |
|---|---|---|---|---|
| 684,688 | A * | 10/1901 | Herz | 482/97 |
| 4,149,714 | A * | 4/1979 | Lambert, Jr. | 482/100 |
| 4,911,431 | A | 3/1990 | Parviainen | |
| 4,940,227 | A * | 7/1990 | Coffey | 482/73 |
| 5,755,645 | A | 5/1998 | Miller | |
| 6,224,514 | B1 * | 5/2001 | Price | 482/50 |
| 6,338,701 | B1 * | 1/2002 | Webber | 482/99 |
| 6,488,612 | B2 * | 12/2002 | Sechrest et al. | 482/103 |
| 6,537,184 | B2 * | 3/2003 | Kim | 482/122 |
| 2002/0068666 | A1 | 6/2002 | Bruccoleri | |
| 2004/0014568 | A1 * | 1/2004 | Williams et al. | 482/37 |

OTHER PUBLICATIONS

Evolution of Strength Training Equipment, Julie M. King, M.S., Copyright 2006. Fitness Management, fitnessmanagement.com (website).

* cited by examiner

*Primary Examiner*—Jerome Donnelly
*Assistant Examiner*—Fenn C. Mathew
(74) *Attorney, Agent, or Firm*—Guy Cumberbatch

(57) ABSTRACT

A method for exercising one or more muscles of the body wherein one or more muscle(s) are contracted to move a limb through a range of motion in opposition to an oscillating resistive force. In accordance with the method, during a muscular contraction, the direction and/or the magnitude of the resistive force changes in an oscillatory fashion. The oscillations in the magnitude and/or the direction of the resistive force include a plurality of cycles during a single repetition of muscular contraction. The waveform and frequency of the oscillations may vary during a repetition or remain constant. Embodiments of devices providing an oscillatory resistive force are presented. The embodiments provide means for enabling an exerciser to perform resistance-type exercises in accordance with the method.

20 Claims, 6 Drawing Sheets

OSCILLATORY RESISTANCE EXERCISE DEVICE AND METHOD

BACKGROUND OF THE INVENTION

1. Field of the Invention

The present invention relates to a method for performing resistance-type exercises and, more particularly, to a method and devices operable for changing the direction and magnitude of a resistive force in a cyclic manner multiple times during a single repetition of muscular contracture.

2. Prior Art

Resistance exercise devices are well known in the art. Resistance exercises normally involve the contraction of a muscle against an opposing resistive force to move a portion of the body through a range of motion. The contraction is usually repeated to include a plurality of cycles (repetitions) of motion of the body portion through the range of motion, which range is determined by the degree of muscular contraction and extension achieved during a repetition. The resistive force may be provided by gravity, as with weight training (barbells, dumbbells, pull-up and pull-down stacks of weights, etc.), or by an elastic force such as springs, bungees and the like.

Weight lifting is an exercise in which muscles are contracted against a resistance that is moved through a range of motion. The resistance is normally in the form of a weighted object that the user moves through either a flexion or extension of a body portion such as the arms or legs. In weight lifting, there are a number of exercises in which the user moves a weighted barbell in order to strengthen his or her upper body muscles. One example of such an exercise is a bench press in which the individual initially assumes a supine position atop a support bench. The weightlifter then uses his or her arms to lift the barbell from a position just above the lifter's chest to a higher vertical position where the lifter's arms are fully extended. This exercise is normally accomplished without any sideways movement (abduction or adduction) of the lifter's hands. This basic exercise can be modified by inclining the support bench (inclined press) or by starting with the bar substantially coplanar with the user's torso (pull overs).

In the biomechanics of limb function, there one or more joints which contribute to the limbs functional motion. Each time the limb moves, motion takes place in one or more of these joints. Limb movement, such as movement of the arm, may include flexion, extension, abduction, adduction, circumduction, internal rotation, and external rotation. These movements are usually defined in relation to the body as a whole. Flexion of the shoulder is a forward movement of the arm. Extension, the reverse of this, is backward movement of the arm. Abduction is the movement of raising the arm laterally away from the body; adduction, the opposite of this, is then bringing the arm toward the side. Circumduction is a combination of all four of the above defined movements, so that the hand describes a circle. Internal rotation is a rotation of the arm about its long axis, so that the usual anterior surface is turned inward toward the body; external rotation is the opposite of this.

All movements of limbs, for example, the arm relative to the shoulder, can be described by the terms used above. It will be appreciated by the artisan that most movements of a limb such as the arm are combinations of two or more of the above defined movements. A plurality of muscles cross each limb joint. Their function is to create motion, and thus the ability to do work with the limb. To perform a given task with precision, power, endurance, and coordination, most, if not all, of these muscles must be well conditioned.

The function of each of these limb muscles depends on its relative position to the joint axis it crosses, the motion being attempted, and any external forces acting to resist or enhance motion of the limb. During limb motion, groups of muscles interact so that a desired movement can be accomplished. The interaction of muscles may take many different forms so that a muscle serves in a number of different capacities, depending on movement. At different times a muscle may function as a prime mover, antagonist, or a fixator or synergistically as a helper, a neutralizer or a stabilizer.

For example, consider flexion of the arm. There are three major joints which contribute to elbow function: the ulnar-humeral, radio-humeral, and the radio-ulnar. The ulnar-humeral is responsible for flexion and extension while the radio-humeral and the radio-ulnar joints are responsible for supination and pronation. Flexion is movement in the anterior direction from the position of straight elbow, zero degrees to a fully bent position such as a curl. Extension is movement in a posterior direction from the fully bent position to the position of a straight elbow.

A plurality of muscles effect motion at each limb joint. For example, in the elbow, these include the Biceps brachii, the Brachialis and the Triceps brachii. These muscles are continually active as their role changes in performing the complex activities of daily living. Each muscle spanning a limb joint has a unique function depending on the motion being attempted. It is generally conceded that in order to fully train and strengthen limb musculature, it is necessary to work the limb in all planes and extremes of motion to optimize neuromuscular balance and coordination.

The types of limb exercise and/or exercise devices currently used in exercise programs generally include isometric, isotonic and isokinetic exercise. Isometrics is an exercise that is performed without any joint motion taking place. For example, pressing a hand against an immovable object such as a wall. When exercising a muscle group within a limb, strength can be improved only in the range of motion in which the limb is being exercised. Since in isometric exercises only one position and one angle can be used at one time, isometric exercise is time consuming if done correctly.

Isotonic exercises are done against a movable resisting force. The resisting force is usually free weights. Isotonic exercises are probably the most common method for exercising both the upper and lower limbs as free weights are relatively inexpensive to acquire and readily available in gyms. A weight is held in the hand and moved in opposition to gravity. It is a functional advantage to be able to move a limb through a full range of motion, but because of the unidirectional nature of gravity, the body position must be continually changed for all muscles to be exercised.

During a single repetition of isotonic weightlifting, the load remains constant but the amount of stress on the muscle varies. The most difficult point in the range is the initial few degrees with a movement to overcome inertia. As the upper extremity comes closer to the vertical position, work becomes easier due to improved leverage. This creates a noncyclic variability in the degree of muscle tension throughout the range of motion. Isotonic exercises can be performed on Nautilus and similar machines which achieve a more uniform resistance. A major disadvantage is that motion on these weightlifting machines is confined to a straight plane movement without deviation which does not replicate normal in-use movement of the limb.

Isokinetic exercise involves a constant speed and a variable resistance. Isokinetic exercise machines are currently limited to movement of a limb in one straight plane. The advantage of exercising a limb with an isokinetic device is that the resistive force can be bi-directional within the single plane of movement. Current isokinetic machines do not permit motion of the limb through different planes during a single repetition.

The particular muscle fibers involved in a contraction during a single repetition of resistive exercise depends upon the direction of the resistive force vector. If the resistive force vector is constant during a repetition, both directionally and in magnitude, as is the case with most prior art resistance exercise devices, only the muscles and portions of the muscle fibers within a muscle that are necessary to counter the resistive force will contract. Push-down/press-down ("PD2") types of exercise devices, such as, for example, disclosed in U.S. patent application Publication No. US2002/0068666 by Bruccoleri, have been further improved to include flexible members attached to a horizontal resistance bar. The flexible members are adapted to be grasped by the hands. In operation, the direction of the resistive force vector changes during a repetition such that different muscles and different muscle fibers within a muscle are exercised during the repetition. While the direction of the resistive force vector at the point of contact with the exercisor's body (i.e., the hands) changes during a repetition using PD2-type devices, the magnitude of the resistive force does not exhibit oscillations during a repetition. The prior art pull-down/press-down resistance type of exercise devices, such as the device shown in FIG. 1, enable the user to exercise a plurality of muscles during a repetition because the plane of motion of the limbs varies during a repetition and it enables a full range of motion of the limb through a repetition. A disadvantage for this type of device is that the vertical component of the resistive force F2 (FIG. 1) is constant during a repetition.

It is desirable to provide a resistance exercise device wherein the direction of the resistive force oscillates in a cyclic fashion during a single repetition in order to increase the number of muscle fibers involved in the contraction over the number required when using a unidirectional device. There is also a need for a resistance exercise device wherein the magnitude of the resistive force oscillates over a plurality of cycles during a single repetition.

SUMMARY

It is an object of the present invention to provide a resistance exercise device operable for providing resistance to the movement of a muscle wherein the magnitude of the resistance oscillates for a plurality of cycles during contraction of the muscle that occurs while performing a single repetition.

It is a further object of the present invention to provide a resistance exercise device operable for providing resistance to the movement of a muscle wherein the direction of the resistance oscillates for a plurality of cycles during contraction of the muscle while performing a single repetition.

It is yet a further object of the present invention to provide a resistance exercise device operable for providing resistance to the movement of a muscle wherein both the direction and the magnitude of the resistance oscillates for a plurality of cycles during contraction of the muscle.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
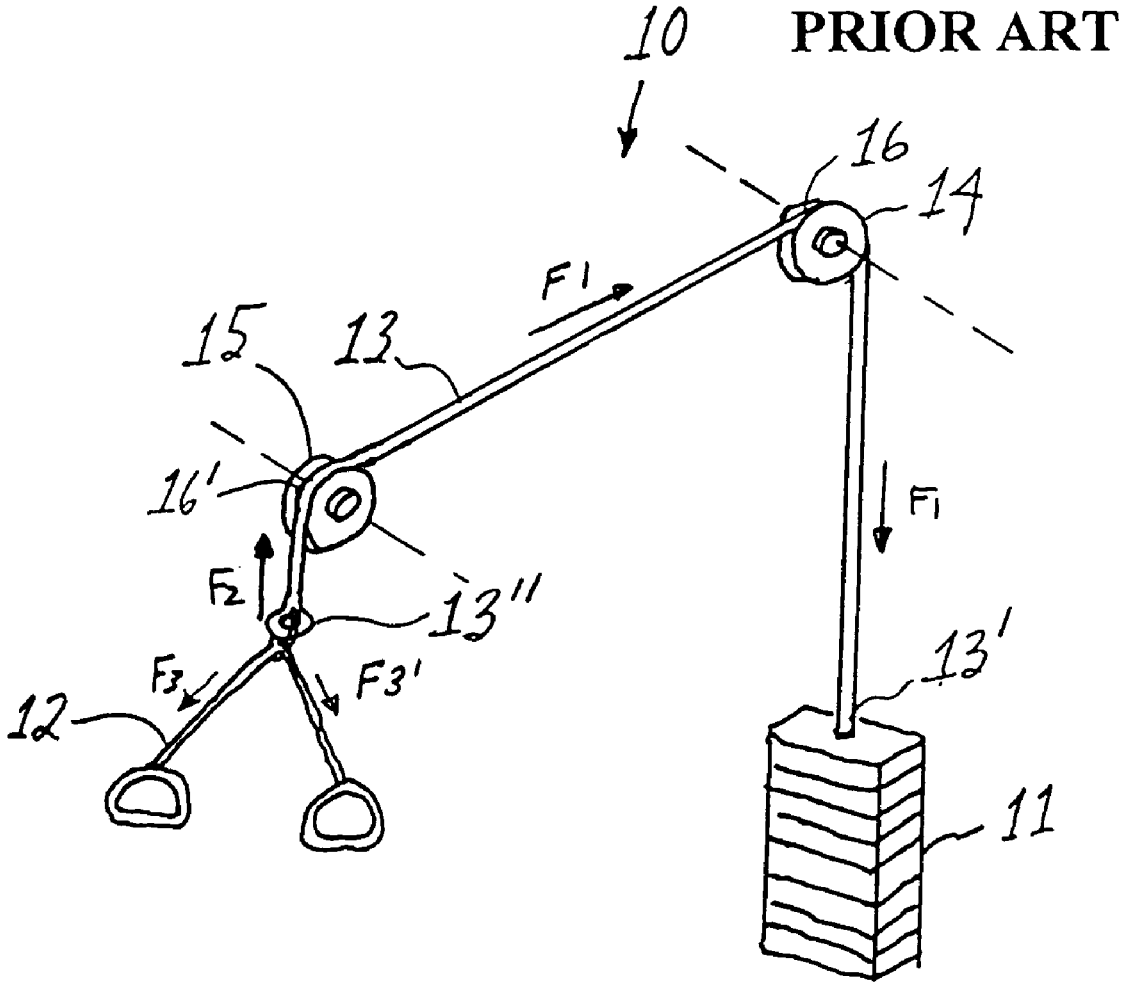
FIG. 1 is a perspective view showing the movable portions of a pull-down/press-down type of exercise device in accordance with the prior art.

Turning now to FIG. 1, a pull-down/press-down (PD2) device in accordance with the prior art is indicated in perspective view at numeral 10. For simplicity, only the moving parts of the PD2 device 10 are shown. In the device 10, a weight stack 11 is in mechanical connection to a handgrip 12 by means of a cable 13. The cable has a trailing end 13' attached to the weight stack 11 and a leading end 13" attached to the handgrip 12. The cable 13 is supported by a rear pulley 14 and a lead pulley 15. The term "lead pulley" as used in the discussion of PD2 devices to follow, refers to the pulley supporting the cable that is closest to the leading end 13" of the cable 13. The handgrip 12 may be a pair of handles connected to the free end 13" of the cable by means of ropes or cables as shown, or it may comprise a bar, or similar grasping means.

If the rear pulley 14 has a circular groove 16, the resistive force F1 (a directional arrow in FIG. 1) will be equal to the weight of the weight stack and oriented in the direction of the corresponding arrow. If the lead pulley 15 also has a circular groove 16', the resistive force vector F2 will be equal to F1 in magnitude. If the sum of the projections of applied force vectors F3 and F3' along the axis defined by F2 is greater than resistive force F2, the weight stack 11 is lifted. When the applied forces F3 and F3' are relaxed, the weight stack returns to its original position until either the applied force F3 and F3' is reapplied, or it comes to rest on a support such as a floor (not shown) when the sum of the projections of F3 and F3' along the axis defined by F2 becomes less than F2.

Figure 2:
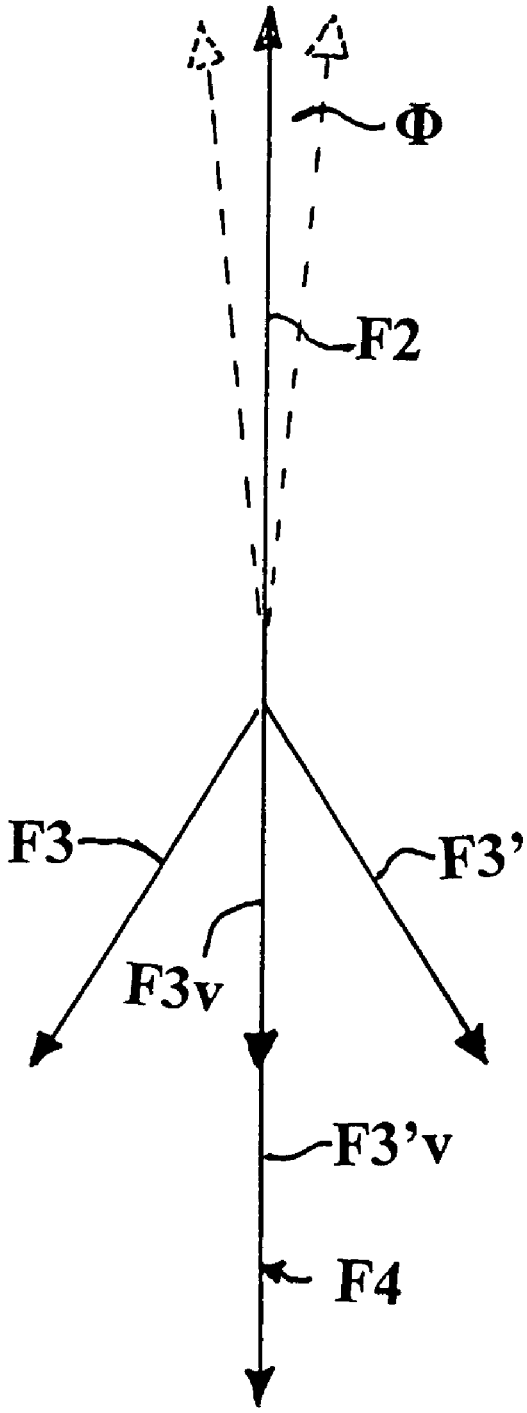
FIG. 2 illustrates the resistive force vector provided by a prior art pull-down/press-down type of exercise device and the contractile force vectors applied by an exercisor that is required to overcome the resistive force vector.

The lead pulley 15 may be modified (FIGS. 4 and 5) such that when the lead pulley 15 turns as the cable 13 passes thereover, the lead pulley 15 changes the direction of F2 to displace the vector F2 through an angle Φ as shown in FIG. 2. FIG. 2 illustrates the resistive force vector F2 provided by a prior art pull-down/press-down type of exercise device and the applied force vectors F3 and F3' applied by an exerciser that is required to provide a resultant force vector F4 having a magnitude greater than the resistive force vector F2 in a direction opposite to F2. As the direction of F2 changes due to the displacement of the cable through an angle Φ, the projections of F3 and F3', F3v and F3'v, along the axis defined by the shifted direction of F2 will also change. The applied forces F3 and F3' must be changed by the exerciser in order to adapt to the fluctuating direction of F2. In order to adapt to the fluctuating (oscillating) direction of F2 during a repetition, the exerciser will need to contract more different muscles than are required with a constant F2.

Figure 3:
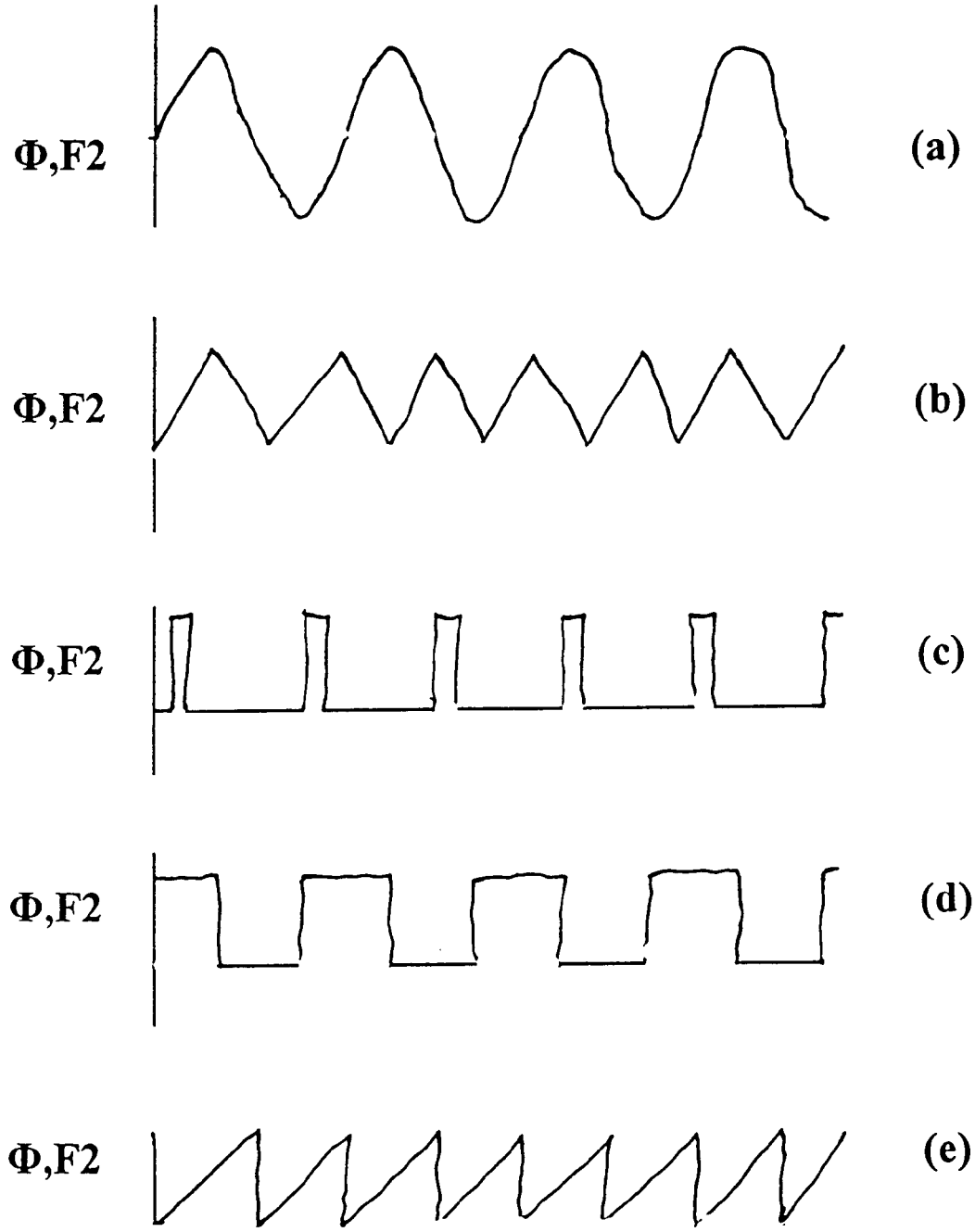
FIGS. 3*a–e* are graphic representations illustrating examples of some of the possible oscillations in the magnitude F2 and/or the direction Φ of the resistive force vector during a single repetition in accordance with the present method. The range of motion during the repetition begins on the left and terminates on the right.

The angle of displacement Φ and the magnitude of F2 can be made to oscillate during a repetition. Some examples of the change in magnitude and direction of F2 that are possible with particular lead pulley constructions, as will be discussed below, are shown in FIGS. 3*a–e*. FIG. 3*a* illustrates a sinusoidal fluctuation in either the magnitude or direction (or both) of F2 that occur during a single repetition. FIG. 3*b* shows sawtooth fluctuations. FIG. 3*c* illustrates a train of narrow pulses whereas FIG. 3*d* illustrates a square wave. FIG. 3*e* shows a modified sawtooth fluctuation in the magnitude and/or direction of F2 during a single repetition.

Figure 4:
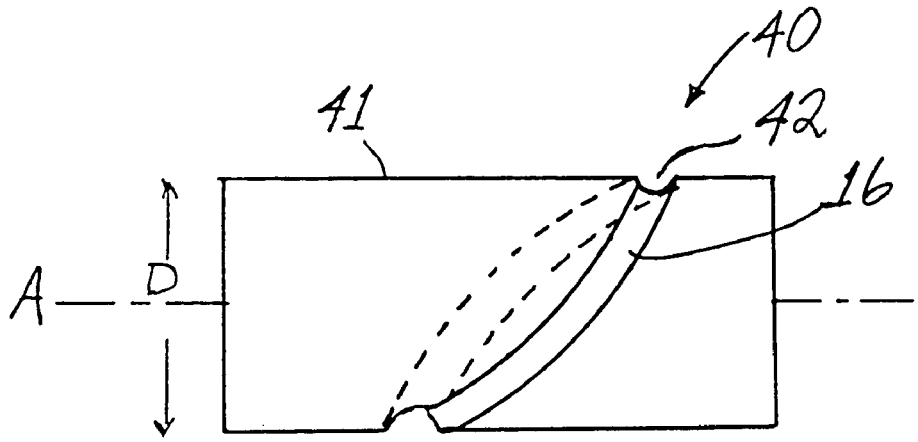
FIG. 4 is an elevational side view of an angular oscillation lead pulley in accordance with a preferred embodiment of an exercise device of the present invention. The angular oscillation lead pulley is used to cyclically change the direction of the resistive force vector F2 a plurality of times during the performance of a single repetition of exercise.

Various means such as mechanical, hydraulic or pneumatic devices may be employed to vary the direction and/or magnitude of the resistive force F2 in an oscillatory manner over a plurality of cycles during a repetition. Mechanical design of the lead pulley is a simple effective means for accomplishing such changes. FIG. 4 is an elevational view of an angular oscillation lead pulley 40 in accordance with a preferred embodiment of a PD2 exercise device of the present invention. The angular oscillation lead pulley 40 is used to cyclically change the direction of the resistive force vector F2 a plurality of times during the performance of a single repetition of exercise. This is accomplished by forming the cable groove 16 in a cylindrical member 41 such that as the cylindrical member 41 turns about its axis of rotation A, the uppermost portion 42 of the groove 16, which supports and guides the cable (the cable is not shown in FIG. 4), travels laterally in an oscillatory manner, returning to its starting position with every complete rotation of the cylindrical member 41. The cylindrical member 41 has a diameter D. The pulleys 40, 50 and 60 are all rotatably mounted and supported on the PD2 device by means of a cylindrical axle (not shown) affixed to the cylindrical member 41 coaxially with the axis of rotation A.

Figure 5:
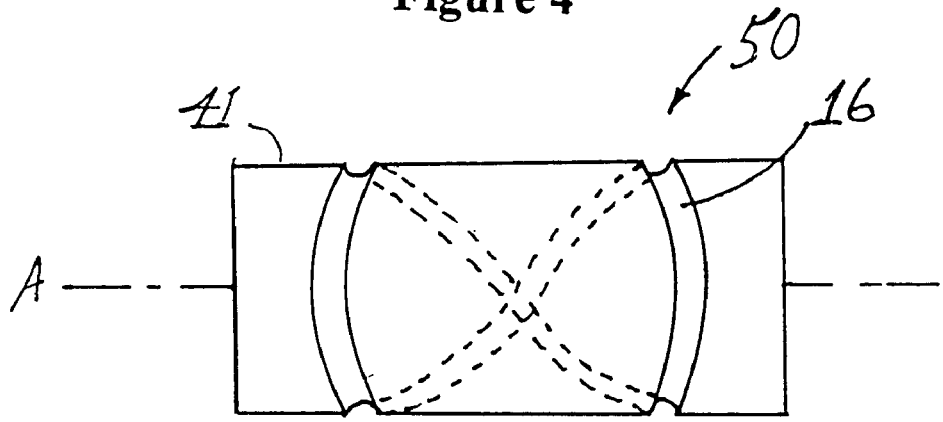
FIG. 5 is an elevational side view of an angular oscillation lead pulley in accordance with another preferred embodiment of an exercise device of the present invention. The angular oscillation lead pulley is used to cyclically change the direction of the resistive force vector F2 nonuniformly and half as frequently during the performance of a single repetition of exercise than the lead pullet shown in FIG. 4.

FIG. 5 is an elevational side view of an angular oscillation lead pulley 50 in accordance with another preferred embodiment of an exercise device of the present invention. The angular oscillation lead pulley 50 is used to cyclically change the direction of the resistive force vector F2 irregularly and half as frequently during the performance of a single repetition of exercise than the lead pulley 40 shown in FIG. 4.

Figure 6:
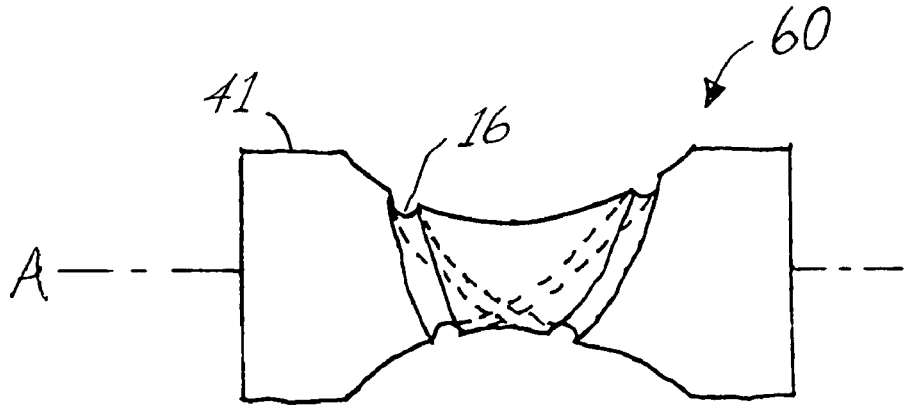
FIG. 6 is an elevational view of a "bowtie" lead pulley in accordance with a second preferred embodiment of an exercise device of the present invention. The bowtie lead pulley simultaneously changes the leverage and thus the magnitude of F2 and the angular displacement Φ of the resistive force vector in an oscillatory manner during the performance of a single repetition.

The lead pulley designs presented above are suitable for providing a resistive force F2 that oscillates in direction during the performance of an exercise repetition. FIG. 6 is an elevational view of a "bowtie" lead pulley in accordance with a second preferred embodiment of an exercise device of the present invention. The bowtie lead pulley 60 has a variable diameter D over the portion of the cylindrical member 41 traversed by the groove 16 and simultaneously changes the leverage and thus the magnitude of F2 and the angular displacement Φ of the resistive force vector in an oscillatory manner during the performance of a single repetition.

The frequency of oscillation of the magnitude and/or direction of the resistive force F2 depends upon the particular lead pulley design and the speed at which the lead pulley rotates about the rotational axis A during the performance of a repetition. The number of cycles in the change of direction and/or magnitude in the resistive force F2 that occurs during a repetition depends on the number of rotations the lead pulley makes during a repetition. It is obvious that for a lead pulley having the groove design illustrated in FIGS. 4–6, a cylindrical member 41 having a small diameter D will provide more oscillations during a repetition than a lead pulley having a greater diameter D. Accordingly, in accordance with the goal of the present invention, it is desirable to select D such that the lead pulley rotates a plurality of times during a repetition.

Figure 7:
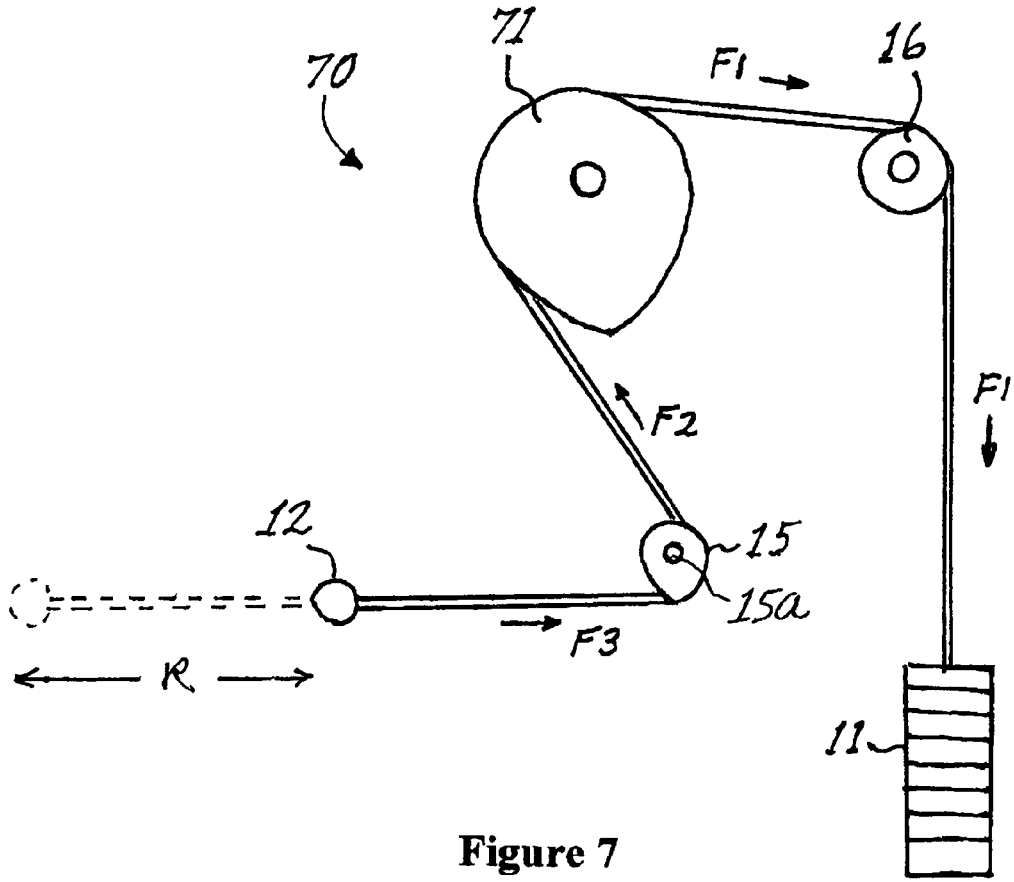
FIG. 7 is a schematic diagram of a pull-down/press-down device in accordance with an embodiment of the present invention employing a cam-like lead pulley having a smaller circumference than the preceding cam-like pulley wherein the magnitude of the resistive force F3 oscillates throughout the range of motion R during a repetition of the exercise.
Figure 8:
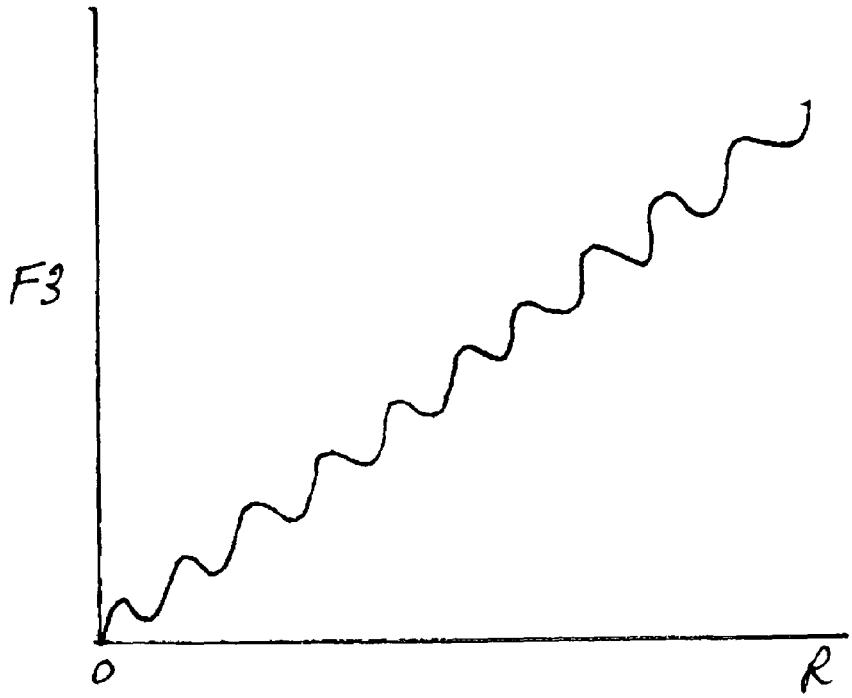
FIG. 8 is a graphical representation showing the change in the resistive force F3 throughout the range of motion R for the embodiment of the invention illustrated in FIG. 7.

FIG. 7 is a schematic diagram of a pull-down/press-down device 70 in accordance with a double cam-pulley embodiment of the present invention. The device 70 employs a cam-like lead pulley 15 having a smaller circumference than the preceding cam-like pulley 71wherein the magnitude of the resistive force F3 oscillates throughout the range of motion R during a repetition of the exercise. FIG. 8 is a graphical representation showing the change in the resistive force F3 throughout the range of motion R for the embodiment of the invention 70 illustrated in FIG. 7.

Figure 9:
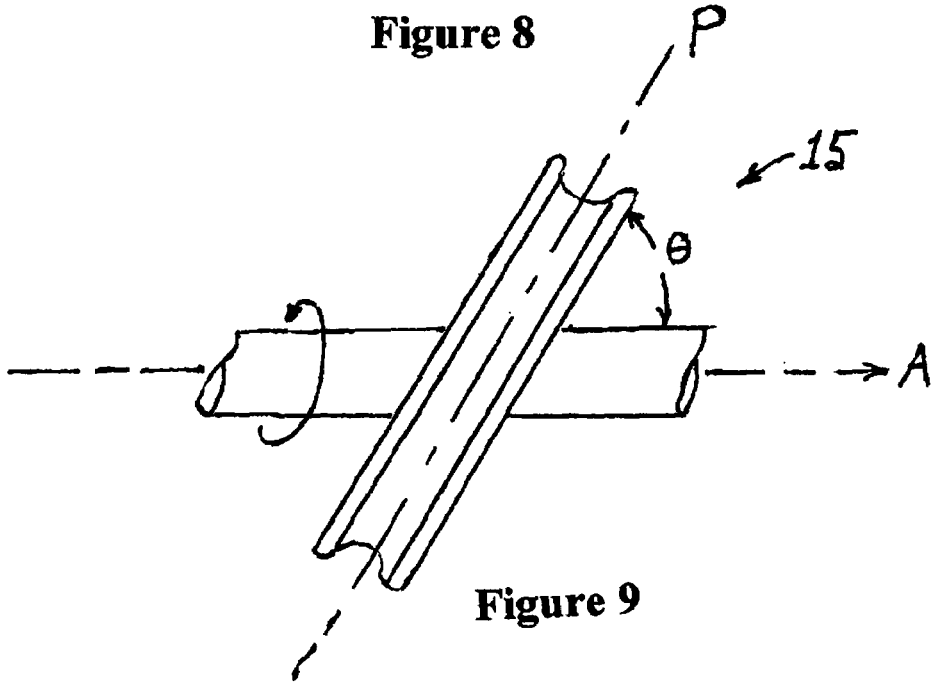
FIG. 9 is a front view of a lead pulley suitable for use with a PD2-type of exercise device to cause the direction of the resistive force to oscillate wherein the plane of the lead pulley is tilted with respect to its axis of rotation.

With continued reference to the PD2 device 70 of FIG. 7, the lead pulley 15 may be cam-shaped and orthogonally mounted on its rotational axis 15*a* as shown or it may be tilted on its rotational axis 15*a*. If the plane of the lead pulley 15 is tilted with respect to its rotational axis 15*a*, the resistive force F3, shown in FIG. 8 for an orthogonally mounted lead pulley, it will be appreciated by the artisan that the resistive force F3 will further have an oscillating component in and out of the plane of the paper (not shown) that is orthogonal to a plane defined by the resistive force vectors F1 and F2. FIG. 9 is a front view of a lead pulley suitable for use with a PD2-type of exercise device that is operable for causing the direction of a component of the resistive force to oscillate in and out of the plane of the paper (FIG. 7). The plane P of the lead pulley 15 is tilted by an angle θ with respect to its axis of rotation A. In addition to being tilted, the lead pulley 15 may also be cam-shaped to provide oscillatory changes in both the direction and the magnitude of the resistive force during a single repetition.

The method for performing an exercise using the devices described above requires that the muscle(s) being exercised adapt to a fluctuating resistive force a plurality of times during a repetition. The adaptation requirement provides means for strengthening more cooperating muscles during a repetition than is possible when countering a constant resistive force. The method and device of the present invention enables the noncontiguous innervation of muscles during a repetition. It is noted that the muscles involved in a repetition "learn" how to adapt if the cyclic variations in the resistive force occur synchronously during each repetition. It is, therefore, desirable to design the exercise device such that the rotational orientation of the lead pulley at the beginning of each repetition is different than the orientation of the lead pulley at the beginning of the previous repetition.

While particular embodiments of the present invention have been illustrated and described, it would be obvious to those skilled in the art that various other changes and modifications can be made without departing from the spirit and scope of the invention. For example, as mentioned hereinabove, a variety of means such as pneumatic or hydraulic pumps and programmable controllers therefore, as well as specially designed lead pulleys as described hereinabove can be employed to cause the resistive force to oscillate in magnitude and/or direction during a repetition. With the use of programmable computer means, the waveform and/or the frequency of oscillations in the resistive force can also be made to fluctuate either in a predictable pattern or a random fashion during a repetition. Further, although the invention has been presented using a PD2 device as an example of a device embodying the principles of the method, other resistance-type exercise devices employing an oscillating resistive force during a repetition are contemplated. It is therefore intended to cover in the appended claims all such changes and modifications that are within the scope of this invention.

The invention claimed is:

1. An exercise machine for exercising one or more muscles of the body of an exerciser, comprising:

a contact member movable in one direction through a distance defining a range of motion;

a source of force;

a mechanical connection that transmits a resistive force from the source of force along a resistive force vector in opposition to movement of the contact member through its range of motion; and a support for the mechanical connection that changes the direction of the resistive force vector a plurality of times during movement of the contact member through its range of motion such that the exerciser experiences an oscillating force vector.

2. The machine of claim 1, wherein the support for the mechanical connection also changes the magnitude of the resistive force a plurality of times during movement of the contact member through its range of motion such that the exerciser also experiences an oscillating magnitude of the resistive force.

3. The machine of claim 1, wherein the support for the mechanical connection is controlled by a device selected from the group consisting of:

a hydraulic pump, a pneumatic pump, and a programmable controller.

4. The machine of claim 1, wherein the support for the mechanical connection is controlled by a programmable controller which randomly changes the direction of the resistive force vector.

5. The machine of claim 1, wherein the oscillating force vector changes direction during movement of the contact member through its range of motion in accordance with a pattern selected from the group consisting of:

a sinusoidal fluctuation, a sawtooth fluctuation, a series of narrow pulses, a square wave, and a modified sawtooth fluctuation.

6. The machine of claim 1, wherein the mechanical connection comprises a cable, and the support comprises a lead pulley having a rotational axis and a groove in which the cable is supported, wherein as the pulley rotates a cable guide portion of the groove oscillates laterally along the pulley axis of rotation.

7. An exercise machine for exercising one or more muscles of the body of an exerciser, comprising:

a contact member movable in one direction through a distance defining a range of motion;

a source of force;

a mechanical connection that transmits a resistive force from the source of force along a resistive force vector in opposition to movement of the contact member through its range of motion; and an oscillator that engages the mechanical connection and changes the magnitude of the resistive force a plurality of times during movement of the contact member through its range of motion such that the exerciser experiences an oscillating magnitude of the resistive force.

8. The machine of claim 7, wherein the oscillator is controlled by a device selected from the group consisting of:

a hydraulic pump, a pneumatic pump, and a programmable controller.

9. The machine of claim 7, wherein the means for changing the magnitude of the resistive force includes a programmable controller which randomly changes the magnitude of the resistive force.

10. The machine of claim 7, wherein the oscillating magnitude of the resistive force changes during movement of the contact member through its range of motion in accordance with a pattern selected from the group consisting of:

a sinusoidal fluctuation, a sawtooth fluctuation, a series of narrow pulses, a square wave, and a modified sawtooth fluctuation.

11. The machine of claim 7, wherein the mechanical connection comprises a cable, and the oscillator comprises a lead pulley.

12. The machine of claim 11, wherein the lead pulley has a rotational axis and a groove with a variable diameter in which the cable is supported.

13. The machine of claim 11, wherein the lead pulley has a rotational axis and a groove in which the cable is supported, wherein as the pulley rotates a cable guide portion of the groove oscillates laterally along the pulley axis of rotation so that the direction of the resistive force vector oscillates a plurality of times during movement of the contact member through its range of motion.

14. A pulley-based exercise machine for exercising one or more muscles of the body, comprising:

a contact member movable in one direction through a distance defining a range of motion;

a cable attached to the contact member;

a lead pulley having a rotational axis and a groove in which the cable is supported;

a source of tensile force on the cable on the opposite side of the lead pulley from the contact member which operates to oppose movement of the contact member through its range of motion and manifests in a resistive force in the cable directed along a resistive force vector from the contact member to the lead pulley; and wherein the lead pulley changes the direction of the resistive force vector a plurality of times during movement of the contact member through its range of motion such that the exerciser experiences an oscillating force vector.

15. The machine of claim 14, further including means for changing the magnitude of the resistive force a plurality of times during movement of the contact member through its range of motion such that the exerciser also experiences an oscillating magnitude of the resistive force.

16. The machine of claim 15, wherein the means for changing the magnitude of the resistive force is selected from the group consisting of:

a hydraulic pump, a pneumatic pump, and a programmable controller.

17. The machine of claim 15, wherein the means for changing the magnitude of the resistive force includes a programmable controller which randomly changes the magnitude of the resistive force.

18. The machine of claim 14, wherein the lead pulley groove has a variable diameter.

19. The machine of claim 14, wherein as the lead pulley rotates a cable guide portion of the groove oscillates laterally along the pulley axis of rotation so that the direction of the resistive force vector oscillates a plurality of times during movement of the contact member through its range of motion.

20. The machine of claim 19, wherein the lead pulley is tilted on its rotational axis.

* * * * *